US008430162B2

(12) United States Patent
Kotsonis et al.

(10) Patent No.: US 8,430,162 B2
(45) Date of Patent: Apr. 30, 2013

(54) CONTINUOUS DOWNHOLE SCALE MONITORING AND INHIBITION SYSTEM

(75) Inventors: Spyro Kotsonis, Missouri City, TX (US); Syed A. Ali, Sugar Land, TX (US); Ives Loretz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 301 days.

(21) Appl. No.: 12/787,190

(22) Filed: May 25, 2010

(65) Prior Publication Data

US 2010/0300684 A1 Dec. 2, 2010

Related U.S. Application Data

(60) Provisional application No. 61/182,412, filed on May 29, 2009.

(51) Int. Cl.

| | |
|---|---|
| ***E21B 37/00*** | (2006.01) |
| ***E21B 41/02*** | (2006.01) |
| ***E21B 47/06*** | (2012.01) |
| ***E21B 47/12*** | (2012.01) |

(52) U.S. Cl.

USPC ..... 166/250.05; 166/53; 166/65.1; 166/66; 166/250.01; 166/250.07; 166/310; 166/312; 166/371; 166/373

(58) Field of Classification Search ..... None
See application file for complete search history.

(56) References Cited

U.S. PATENT DOCUMENTS

| | | | | |
|---|---|---|---|---|
| 6,851,444 | B1 * | 2/2005 | Kohl et al. | 137/13 |
| 6,880,402 | B1 | 4/2005 | Couet et al. | |
| 6,981,553 | B2 * | 1/2006 | Stegemeier et al. | 166/300 |
| 7,234,524 | B2 * | 6/2007 | Shaw et al. | 166/304 |
| 2003/0038734 | A1 * | 2/2003 | Hirsch et al. | 340/853.1 |
| 2003/0071988 | A1 * | 4/2003 | Smith et al. | 356/128 |
| 2004/0060703 | A1 * | 4/2004 | Stegemeier et al. | 166/310 |
| 2008/0163692 | A1 | 7/2008 | Huang et al. | |
| 2008/0163700 | A1 | 7/2008 | Huang | |
| 2008/0169098 | A1 * | 7/2008 | Christopher et al. | 166/275 |
| 2009/0101344 | A1 | 4/2009 | Crow et al. | |
| 2009/0294123 | A1 | 12/2009 | Mescall et al. | |

FOREIGN PATENT DOCUMENTS

| | | | |
|---|---|---|---|
| GB | 2402738 | A | 12/2004 |
| WO | 2003042675 | A1 | 5/2003 |

* cited by examiner

*Primary Examiner* — George Suchfield
(74) *Attorney, Agent, or Firm* — Brandon S. Clark; Robert Van Someren

(57) ABSTRACT

A technique facilitates monitoring of conditions which are prone to cause scale precipitation around downhole equipment. The technique also enables a local, downhole reaction to the potential for precipitation of scale. A downhole scale monitoring and inhibition system may be provided with a measurement module and injection module. The measurement module monitors at least one downhole parameter indicative of the potential for scale formation. In response to data output from the measurement module, the injection module is operated to provide downhole, local injections of an inhibitor chemical.

22 Claims, 3 Drawing Sheets

CONTINUOUS DOWNHOLE SCALE MONITORING AND INHIBITION SYSTEM

CROSS-REFERENCE TO RELATED APPLICATION

The present document is based on and claims priority to U.S. Provisional Application Ser. No. 61/182,412, filed May 29, 2009.

BACKGROUND

Hydrocarbon fluid, e.g. oil and natural gas, often are obtained from a subterranean geologic formation, referred to as a reservoir, by drilling a wellbore which penetrates the hydrocarbon-bearing formation. In many cases, the downhole environment presents harsh operating conditions, e.g. high temperatures, caustic chemicals, and cramped space constraints, with respect to downhole equipment. Additionally, many modern downhole tools require relatively close tolerances and numerous operating cycles to effectively and efficiently produce hydrocarbon fluid from the reservoir. The downhole conditions can cause scale to build up on surfaces of mating components and can impact the ability to control or fully operate the downhole tool in response to operational parameters or changing conditions at the well. Downhole scale also may lead to a reduction in productivity or performance due to obstructed flow passages.

As a result, various techniques are employed to inhibit formation of scale. Even so, scale and other particulates continue to cause equipment malfunctions and well productivity losses. One approach to inhibiting scale involves the metered injection of scale inhibiting chemicals through chemical injection lines extending from the surface. However, a significant drawback of this approach is an inefficient use of inhibitors because in situ conditions and scale creation progress is not precisely known and cannot be precisely determined. Therefore, operators typically prefer to err on the conservative side and over-inject chemicals rather than under-inject chemicals; and this over-injection leads to the inefficient use of inhibitors or it can cause adverse effects due to oversaturation of inhibitors in the produced fluids.

Even when the scale inhibitor chemicals are over-injected, many downhole situations and circumstances still allow for the continued growth of scale. Additionally, a further complication arises when downhole completions equipment is operated after remaining stagnant for many months or years because parts may have seized with scale.

SUMMARY

In general, the present invention provides a technique for monitoring and reacting locally to conditions which are prone to cause scale precipitation around downhole equipment. In one embodiment, a downhole scale monitoring and inhibition system is provided with a measurement module and an injection module. The measurement module monitors at least one downhole parameter indicative of the potential for scale formation. In response to data output from the measurement module, the injection module is operated to provide precise, downhole, local injections of an inhibitor chemical.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
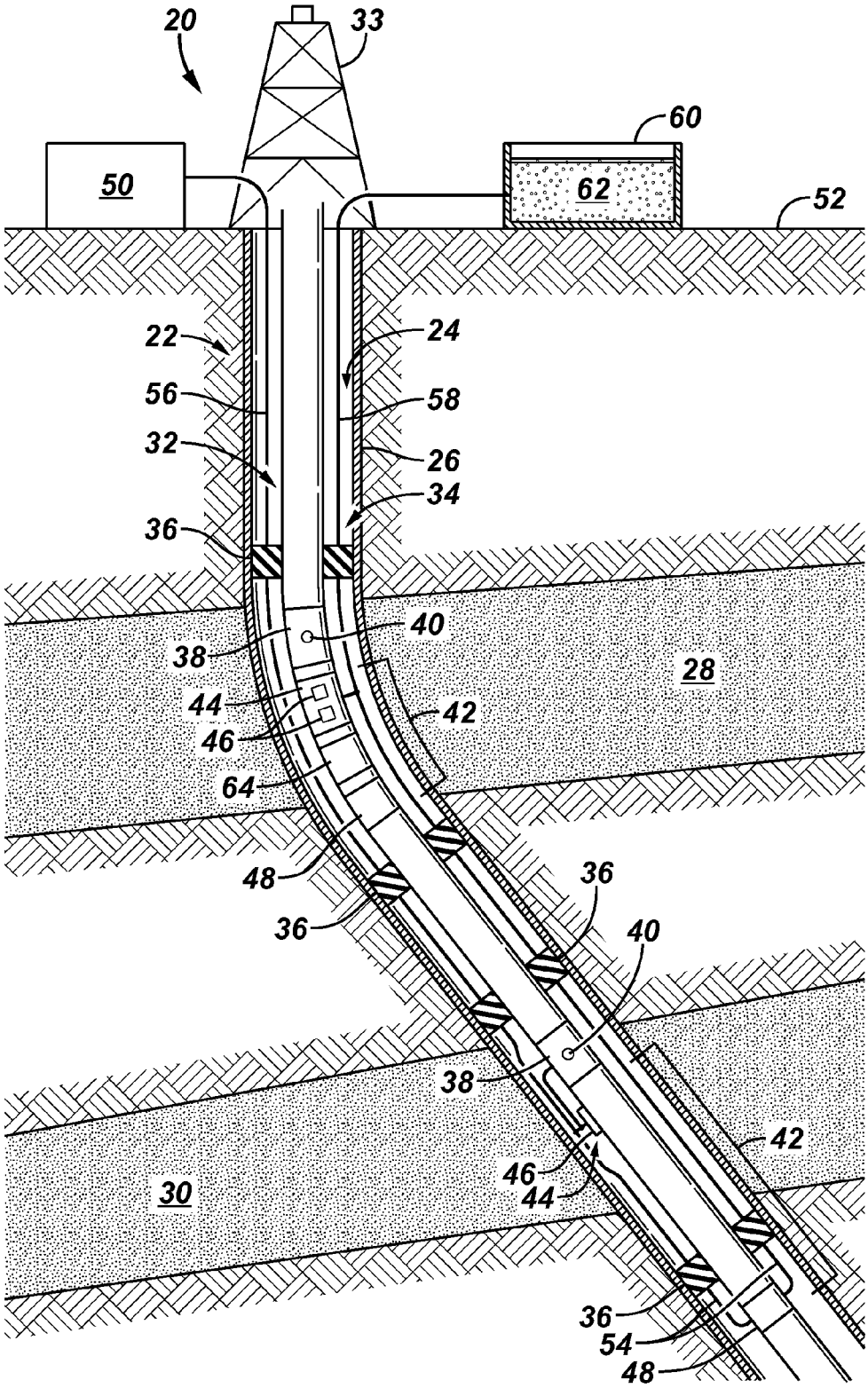
FIG. 1 is an illustration of a well system employed in a wellbore and incorporating a scale monitoring and inhibition system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a method and system for detecting and inhibiting build up of particulates. In various applications, the method and system may be used to monitor and inhibit build-up of scale in downhole locations. However, the technology may be employed in a variety of other environments and applications.

In general, the present technique incorporates equipment, modeling, and/or data analysis, to facilitate detection and inhibition of the unwanted build-up on downhole equipment. For example, the technique may be used to monitor and locally react in real-time to conditions that are prone to cause scale precipitation around downhole equipment, e.g. downhole well tools. Various embodiments comprise both monitoring and scale inhibition equipment combined with various downhole equipment structures, such as downhole well completions. Common types of scale include calcium sulfate, barium sulfate, strontium sulfate, calcium carbonate, aragonite, siderite, iron sulfide, zinc sulfide, and sodium chloride.

The overall scale monitoring and inhibition system comprises a monitoring apparatus having various sensors designed to take in situ measurements of conditions which may be related to an increased risk of scale creation. For example, the in situ measurements may comprise pressure measurements, temperature measurements, flow rate measurements, water cut measurements, and/or specific fluid property measurements, such as measurements of pH-value, chemical composition, and other fluid properties. The presence of water in the hydrocarbon production fluid, under various conditions, results in scale creation. Therefore, monitoring of water cut in the hydrocarbon based production fluid provides data which is useful in certain embodiments of the scale monitoring and inhibition system. However, other measurements may be used in the alternative or in addition to the water cut detection to further provide an indication of scale build-up or at least the potential for scale build-up. Once the condition is detected, e.g. incursion of water, knowledge of this parameter change enables the targeted injection of inhibitor chemicals proximate to the downhole tool susceptible to scale build-up. Examples of suitable scale inhibitors comprise carbonate scale inhibitors, e.g. pteroyl-L-glutamic acid, alkyl ethoxylated phosphates, ethylene diamine tetramethyl phosphonic acid, hexamethylenediaminepenta (methylenephosphonic) acid, diethylenetriaminepenta (methylenephosphonic) acid, N-bis(phosphonomethyl) amino acid, N-substituted aminoalkane-1,1-diphosphonic acids, ether diphosphonate, and phosphinicosuccinic acid oligomer; sulfate scale inhibitors, e.g. polyepoxysuccinic acid, polyaspartic acid, polyamino acid, homopolymers and copolymers of acrylic acid, polyvinyl sulfonate, mixtures of aminotri (methylenephosphonic acid and diethylenetriamine penta(methylenephosphonic acid, and polyposphate; sulfide scale inhibitors, e.g. hydroxyethylacrylate/acrylic acid copolymer (ZnS); or salt inhibitors, e.g. nitrilotriacetamide and its salts, potassium ferrocyanide, and urea and ammonium chloride mixture.

The scale monitoring and inhibition system also may be constructed such that it can reduce layers of already deposited scale. In other words, rather than measuring the conditions which may lead to scale formation the sensors may be designed to detect actual scale build-up on certain components. Once scale build-up is detected, suitable solvents may be injected locally to remove the established deposits. This methodology also may be combined with the preventive application of inhibitors if desired. By directly detecting the actual scale build-up on certain downhole components, valuable information is obtained to help initiate additional procedures, where needed, that are aimed at removing scale by traditional intervention methods, e.g. coiled tubing, well tractors, wireline, or slickline methods. In some applications, an automated inhibitor injection system could be omitted and scale removal could be accomplished by alternative methods. This may be beneficial if the risk of scale build-up is relatively small and/or the initial investment for a controlled injection system is not warranted. Examples of scale dissolvers comprise carbonate scale dissolvers, e.g. hydrochloric acid, acetic acid, formic acid, glutamic acid diacetic acid, ethylenediaminetetraacetic acid, and hydroxyethylethylenediaminetriacetic acid; sulfate scale dissolvers, e.g. diethylenetriaminepentaacetic acid, and diethylenetriaminepentaacetic acid (penta potassium salt); sulfide scale dissolvers, e.g. hydrochloric acid, and diammonium dihydrogen ethylenediaminetetraacetate; and salt dissolvers, e.g. water.

In some embodiments, the scale monitoring and inhibition system may comprise a plurality of systems. For example, the scale monitoring and inhibition system may comprise multiple monitoring devices and multiple injection devices to provide scale control in, for example, a production well at specific reservoir levels. In some applications, the injected inhibitor chemical is mixed with the production flow before effectively mitigating scale build-up. Use of the plurality of systems enables measurement of scale producing conditions at various locations of interest, e.g. around movable or adjustable equipment, while scale inhibiting agents are injected upstream of the targeted location. The separation of measurement and injection may provide a mixing region which allows the one or more inhibitor agents to properly mix with the production flow before arriving at the targeted location.

Referring generally to FIG. 1, an embodiment of a well system 20 is illustrated as deployed in a well 22. The well 22 is defined by a wellbore 24 which may be lined with a liner or casing 26. In the embodiment illustrated, wellbore 24 extends into a subterranean region and through one or more reservoir formations, such as reservoir formations 28, 30. The reservoirs 28, 30 contain desirable production fluids, such as oil and/or gas. Depending on the environment and the arrangement of reservoirs 28, 30, wellbore 24 may have vertical and/or deviated sections extending through the reservoir regions. In the embodiment illustrated, for example, wellbore 24 comprises a deviated or lateral wellbore section which is representative of one or more lateral wellbore sections.

A downhole equipment string 32, e.g. a completions string, is conveyed downhole from a surface rig or other deployment equipment 33 and may comprise a variety of downhole equipment 34, such as a downhole completion. By way of example, downhole completion 34 comprises a plurality of isolation devices 36, e.g. packers, deployed to isolate specific wellbore regions, such as the regions spanning reservoirs 28 and 30. The downhole completion 34, or other downhole equipment, also may comprise one or more downhole tools 38 which have moving parts potentially susceptible to scale build-up. In many applications, at least one of the downhole tools 38 comprises a valve 40, such as a flow control valve. However, the downhole tool 38 also may comprise completion tubing susceptible to scale build-up.

The downhole equipment 34 also comprises a scale monitoring and inhibition system 42. System 42 is designed to monitor one or more downhole parameters indicative of possible scale build-up and also to react locally with respect to a specific downhole tool 38. The local reaction may comprise injecting a scale inhibitor proximate to the downhole tool for reaction with the downhole tool, thereby preventing, limiting and/or removing scale precipitation.

In the embodiment illustrated, the scale monitoring and inhibition system 42 may comprise a monitoring module 44 having one or more sensors 46 designed to detect at least one well parameter which indicates accumulation or the potential for accumulation of scale on the local downhole tool 38. FIG. 1 illustrates an upper scale monitoring and inhibition system 42 in which the monitoring module 44 is designed as a sub coupled directly into the downhole equipment string 32. However, the monitoring module 44 and sensors 46 may have a variety of configurations. For example, a lower scale monitoring and inhibition system 42 is illustrated with independent sensors 46.

Depending on the characteristics of the subterranean environment and of the specific application, sensors 46 may be designed to detect a variety of parameters indicative of conditions leading to scale build-up. By way of example, sensors 46 may be designed to detect pressure/pressure differentials, temperature, flow rate, water cut, and various combinations of these and/or other downhole parameters. As discussed above, the detection of water cut in the produced hydrocarbon fluid may be used in many applications as a strong indicator of the potential for scale creation on the proximate downhole tool 38. Sensors also may be designed to detect scale build-up after deposits have already occurred on certain components or test sections. This may be a preferential or complementary approach in cases where the removal of scale is easier to manage than the prevention of scale formation.

Referring again to FIG. 1, each scale monitoring and inhibition system 42 also comprises an injection module or tool 48 which works in cooperation with monitoring module 44. For example, sensor data output by monitoring module 44 may be processed by a control system 50 and used to determine the potential for scale formation. The control system 50 is used to activate the corresponding injection module 48 for providing a local application of scale inhibitor chemical. By way of example, control system 50 may be a processor based system located at a surface location 52, as illustrated, or at a downhole location. For example, control system 50 may be incorporated into or positioned proximate one or more of the injection modules 48 for control of individual or multiple injection modules. As a result, the injection decision can be made downhole for one or more injection modules via control signals sent by direct communication line or wirelessly.

Data obtained by the monitoring module 44 and provided to control system 50 enables precise control over injection module 48 to apply the appropriate amount of chemical inhibitor for maintaining continued operation of the corresponding downhole tool 38. In specific applications, control system 50 enables real-time processing of the data from monitoring module 44 to implement automatic, real-time injection of appropriate amounts of the inhibitor chemical via injection module 48. In other applications, the control system 50 may be used in response to data from the monitoring modules 44 to selectively send a surface command to a specific injection module or modules 48.

The injection module 48 may be constructed in several forms with a variety of controllable valves, orifices, or other components designed to enable injection of the desired inhibitor, or dissolving, chemical or chemicals. In one embodiment, the injection module 48 comprises an injection sub incorporated directly into the downhole equipment string 32, as illustrated in the upper scale monitoring and inhibition system 42 of FIG. 1. In this embodiment, the injection sub 48 injects the inhibitor chemical upstream of the downhole tool 38 to allow the inhibitor chemical to mix with the produced well fluid and flow to the downhole tool 38 for reaction with the tool. In other embodiments, such as the lower illustrated scale monitoring and inhibition system 42, the injection module 48 may directly inject one or more chemical inhibitors into the corresponding downhole tool 38 via injection lines 54 or other suitable injection passages.

Regardless of the specific design of the injection module 48, monitoring of the one or more downhole parameters, e.g. pressure, temperature, flow rate, water cut and/or actual scale build-up, enables the valves or other control mechanisms within injection module 48 to be appropriately adjusted for injection of the precise amount of inhibitor chemical to eliminate and/or prevent scale. By way of example, each injection module 48 may be powered via electrical power supplied through a communication line 56 routed downhole to the one or more injection modules 48 from control system 50 or from another suitable power source. The communication line 56 also may comprise data signal lines for carrying the data signals from the one or more monitoring modules 44 and/or for carrying command signals to injection modules 48 and/or control system modules 50 which are located downhole. The communication line 56 which is employed for carrying data also may comprise a wireless communication line. Additionally, one or more scale inhibiting chemicals may be supplied to the injection modules 48 through a separate or combined communication line 58 routed downhole from a supply system 60 containing one or more scale inhibiting chemicals 62.

In some applications, the scale monitoring and inhibition system 42 also comprises a mixing module 64, e.g. a mixing sub, designed to improve mixing of the scale inhibitor chemical 62. For example, the mixing sub 64 may be designed to enhance the mixing of scale inhibitor chemical 62 with a flowing production fluid, e.g. oil, to provide an effective dispersion of the inhibitor chemical over downhole tool 38. In other applications, the mixing sub 64 may be designed to mix two or more inhibitor chemicals 62 with each other and/or with the flowing production fluid to further enhance scale prevention and/or elimination. It should be noted that supply 60, fluid communication lines 58, and the overall scale monitoring and inhibition system 42 may be designed to apply more than one scale inhibitor chemical either mixed or independently.

Figure 2:
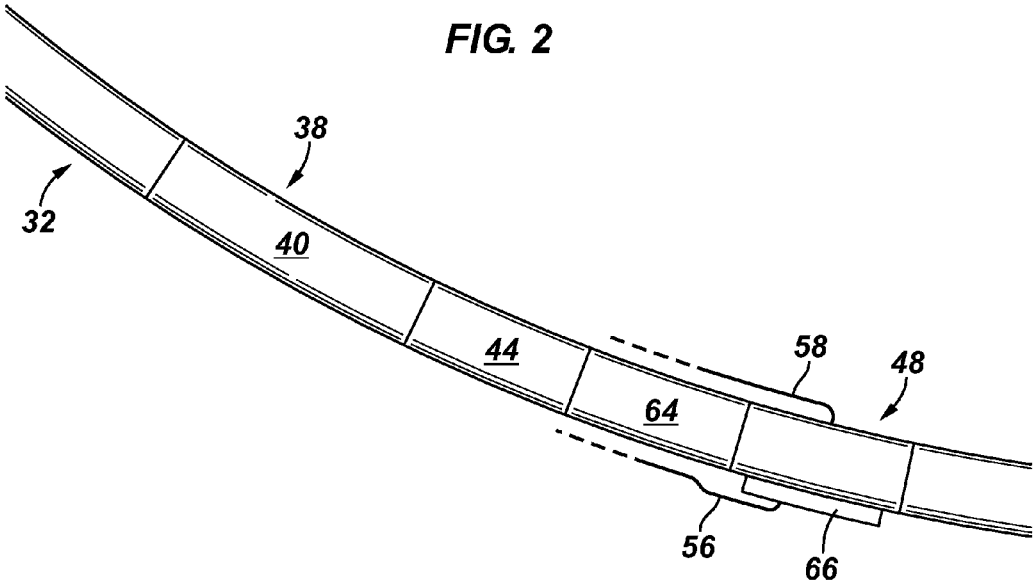
FIG. 2 is a schematic illustration of one example of the scale monitoring and inhibition system working in cooperation with a downhole component, according to an embodiment of the present invention.

Referring generally to FIG. 2, one example of the scale monitoring and inhibition system 42 is illustrated as joined into downhole equipment string 32 for cooperation with the proximate downhole tool 38. In this example, the downhole tool 38 is a flow control valve which may be selectively operated to control flow along the downhole equipment string. Measurement module 44, injection module 48, and mixer module 64 are constructed as subs connected directly into the downhole equipment string 32. The mixer module 64 is a non-invasive mixer module which separates the monitoring module 44 from the injection module 48 and may be designed to provide minimal pressure drop across the mixer module and to allow pass-through of intervention tools. As illustrated, the components may be coupled into downhole equipment string 32 at a position upstream of the flow control valve 40.

The measurement module 44 is designed to measure one or more of the parameters indicative of scaling, as discussed above. The measurements may be combined with various models, known data of the lithology (e.g. carbonates prone to scale creation), and data on the produced fluid composition to facilitate analysis by the processor based control system 50. For example, some wells are produced through the use of sea water flooding methods which further increase the risk of scale formation due to the possibility of saltwater contamination eventually being produced through the production wells. This knowledge enables appropriate construction and use of both the monitoring module 44 and the control system 50 for exercising appropriate injections of the inhibitor chemical. As discussed above, the control system 50 may be employed to automatically make real-time adjustments to the inhibitor chemical injection regime based on data output by the monitoring module 44.

In certain applications, selection of appropriate or optimized intervals for the injection schedule/regime is affected by the presence of water. If no water is present in the flowing production fluid, no scale inhibiting agents may be required, at least in some environments. Therefore, specific embodiments of the scale monitoring and inhibition system 42 are designed to react to the presence of water, or other scale forming indicators, and to selectively initiate or deactivate the injection schedule based on these downhole parameters. Selection of the appropriate or optimized intervals for injection often also includes determining the quantity and type of chemical or chemical mixture to be injected.

Depending on the environment in which the scale monitoring and inhibition system is employed, the measurement module 44 may be designed to monitor additional or alternate parameters. For example, measurement module 44 may monitor: differential pressures across the tubing (annulus versus internal); the position of a flow control valve or other downhole tool; the condition or health status of completion components; or other parameters that may provide desired indications in a given environment. In some environments, for example, monitoring resistivity can be useful in determining scale build-up.

Similarly, the chemical injection module 48 may be designed to accommodate many types of environments and applications. In some applications, each chemical injection module 48 has two communication lines, e.g. communication lines 56, 58, routed from the surface and connected to the module. The chemical injection module also may be designed to vary the dosage of injected inhibitor chemical and/or to close the injection line completely. In some environments, the injection module is designed to vary the dosage of inhibitor chemical via an electronically variable device 66, such as a controllable valve or a variable port, while in other cases the port opening remains constant. If the port opening remains constant, the dosage may be varied by other techniques, such as use of pulsing or time interval delivery. These and other techniques for controlling delivery of the inhibitor chemical 62 may be used individually or in combination.

In some applications, it is desirable to measure and monitor downhole parameters in more than one location to obtain a better representation of conditions at multiple locations along the well 22. This type of multiple system also enables injection of inhibitor chemical at a plurality of locations to mitigate scale growth on equipment at a variety of locations along the downhole equipment string 32. In these applications, the overall scale monitoring and inhibition system 42 utilizes a plurality of systems having a plurality of monitoring modules 44 and injection modules 48 to enable controlled injection of scale inhibitors at multiple locations, as illustrated in the schematic example of FIG. 3.

Figure 3:
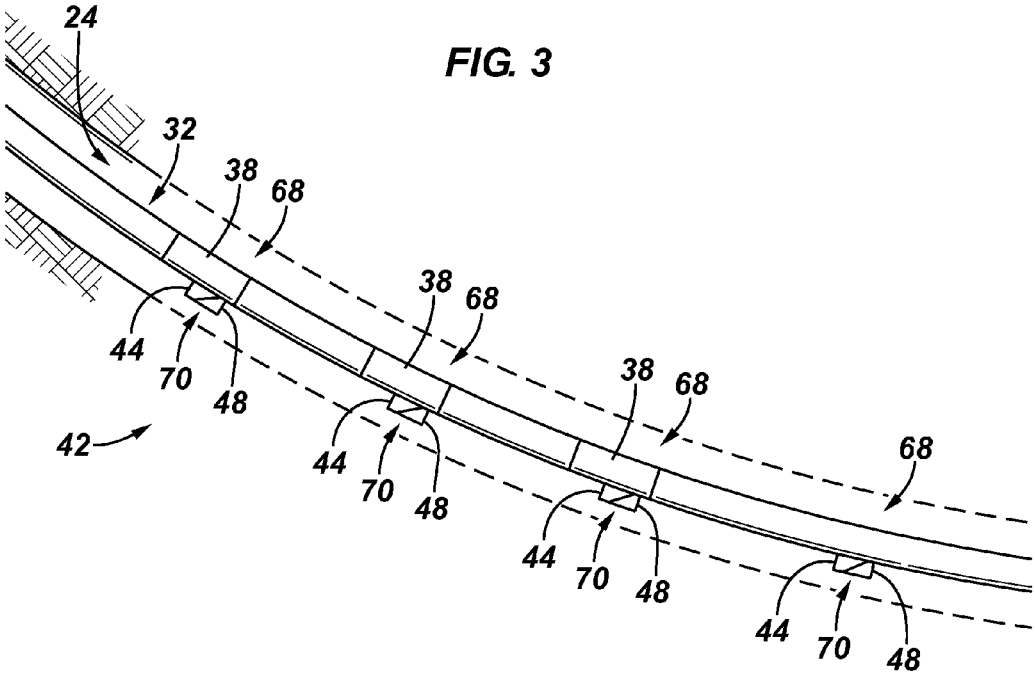
FIG. 3 is a schematic illustration of a multiple location scale monitoring and inhibition system deployed in a single wellbore, according to an embodiment of the present invention.

In the embodiment illustrated in FIG. 3, a multiple scale monitoring and inhibition system 42 is illustrated in which a plurality of monitoring modules 44 and injection modules 48 are deployed at a plurality of locations 68 along the downhole equipment string 32. In this example, each unique combination of monitoring module 44 and injection module 48 (and potentially mixing module 64) is illustrated as a condition and injection (CI) system 70. At least several of the CI systems 70 are each in close proximity with a corresponding downhole tool 38 and may be positioned just upstream or downstream of the tool 38.

In some applications, one or more of the CI systems 70 may be located separate from the downhole tools 38. For example, CI systems 70 and corresponding downhole tools 38 are not necessarily deployed in a one-on-one relationship. Instead, these applications may employ differing numbers of CI systems 70 and downhole tools 38. Additionally, the multiple CI systems 70 may be collectively linked to control system 50 for individual and/or cooperative control. As a result, the multiple system is adaptable to a wide variety of downhole situations. If, for example, the monitoring information from one CI system 70 positioned at one of the locations 68 indicates the presence of scale creation conditions, the inhibitor chemical 62 may be injected at a separate upstream location 68. The upstream injection location may be selected to allow enough length between the injection location and the subject downhole tool 38 to effectively mix with production fluid and to better mitigate scale creation at the downstream location. In other applications, however, monitoring of the wellbore parameter/condition and injection of the inhibitor chemical 62 may occur substantially at the same location 68 as the subject downhole tool 38. In some applications, the injection point may even be downstream of the subject downhole tool 38.

According to one embodiment, at least one of the scale monitoring and inhibition systems 42 is constructed as a distributed injection system having multiple CI systems 70. In this example, the monitoring modules 44 also monitor zonal flow rates to determine the relative proportion of injection fluid required at each CI system location. Application of this type of embodiment can be beneficial when comingling of production fluids occurs between different sections of CI systems 70, as is the case when permanent flow control valves are used to control the contribution from several independent reservoir zones.

In some embodiments of the scale monitoring and inhibition system 42, the number of communication lines, e.g. communication lines 56, 58, extending from the surface location 52 is limited. For example, a single electrical power and communication line 56 may be combined with a single chemical injection line 58 for carrying power, data and inhibitor chemical to a plurality of monitoring modules 44 and injection modules 48 coupled together in series. Based on data from individual monitoring modules 44, control system 50 may be used to provide suitable control and power signals to specific injection modules 48 for injecting inhibitor chemicals 62 via the single chemical injection line 58.

In a variety of well applications, the downhole completion 34 also comprises reservoir monitoring and control equipment able to return in situ measurements, e.g. pressure measurements, temperature measurements, valve actuation information from flow control valve position sensors, and other types of measurements/information. This data also may be sent to control system 50 and processed in combination with data from monitoring modules 44 to facilitate better control over injection of inhibitor chemical 62 via specific injection modules 48. In this type of embodiment, additional communication lines, e.g. power lines and data lines, may be coupled with control system 50.

Some embodiments also may utilize two or more chemical injection lines 58 employed to provide different formulations of inhibitor chemicals 62 for various scale prevention/removal tasks downhole. In this type of embodiment, the control system 50 may be programmed to provide a controlled injection of the appropriate dosage of each of the variety of inhibitor chemicals 62, thus allowing the injection of chemicals to be more closely tailored to the surrounding conditions. It also should be noted that additional communication lines, e.g. power, data and injection lines, may be provided for redundancy to enable continued operation if individual communication lines are damaged during run in. Use of two or more electrical power/data communication lines also may reduce the impact of noise appearing on the communication lines.

Figure 4:
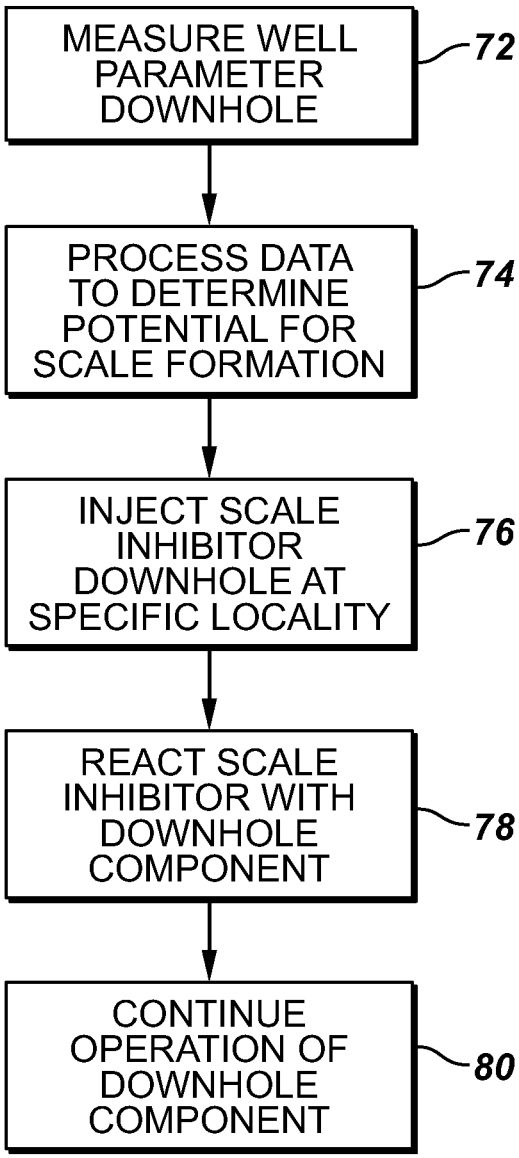
FIG. 4 is a flowchart illustrating an example of a scale monitoring and inhibition procedure, according to an embodiment of the present invention.

Referring generally to the flow chart of FIG. 4, one operational example is provided with respect to using the scale monitoring and inhibition system 42 for monitoring a wellbore location and for reacting locally in real-time to conditions prone to cause scale precipitation around downhole equipment. It should be noted, however, that many operational procedures may be employed depending on the environment and the design of the overall scale control system, e.g. the number of monitoring modules 44 and injection modules 48. In this specific example, one or more well parameters is initially measured and monitored at a downhole location via at least one monitoring module 44, as indicated by block 72.

Data output by the at least one monitoring module 44 is processed via processor based control system 50 to determine the potential for scale formation, as indicated by block 74. The control system 50 may utilize a variety of data, e.g. data on water cut, provided by the monitoring module 44 and potentially by other sensors in the downhole completion 34. The data is processed and if scale formation or a potential for scale formation is determined, scale inhibitor chemical(s) 62 is injected downhole in specific amounts at one or more specific localities via at least one injection module 48, as indicated by block 76. By precisely injecting the scale inhibitor chemical, efficient use of the chemical is accomplished while still enabling sufficient reaction of the scale inhibitor with the subject downhole component 38, as indicated by block 78. This allows the continuous, dependable operation of the subject downhole component 38, as indicated by block 80. It should be noted that one or more inhibitor chemicals 62 may be designed to remove scale and/or to prevent precipitation of scale on the downhole tool.

Detection and inhibition of scale formation may be accomplished in a variety of environments with several arrangements of components. For example, the scale monitoring and inhibition systems 42 may be constructed in various configurations with several component types incorporated into the downhole completion or other downhole equipment. Monitoring of downhole parameters indicative of scale formation may be accomplished by various sensors depending on the environment, e.g. type of surrounding formation, and the type of control system implemented. Control over the injection of inhibitor chemical may be achieved with several types of injection subs *or* other injection devices.

Additionally, the injection module may be electrically, hydraulically, or otherwise actuated to control a variety of valves, orifices, ports, or other features able to control the specific amount of inhibitor chemical injected for reaction with a corresponding downhole tool. The control system also may have a variety of configurations and programs for processing data received from the one or more monitoring modules and for exercising control over the corresponding injection modules. In many applications, the control system is designed to exercise automatic, real-time control over the injection modules based on data received in real-time from the monitoring modules via the corresponding communication line.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for detecting and controlling the formation of scale in a wellbore, comprising:

a completions string deployed in a wellbore, the completions string comprising:

a downhole component susceptible to scale formation; and a scale monitoring and inhibition system having a measurement module able to detect at least one downhole parameter indicative of possible scale build-up; a chemical injection tool to inject a scale inhibitor chemical into the wellbore for interaction with the downhole component in response to an output from the measurement module; and a fluid mixer positioned downhole to mix the scale inhibitor chemical.

2. The system as recited in claim 1, wherein the downhole component comprises a completion tubing.

3. The system as recited in claim 1, wherein the downhole component comprises a flow control valve.

4. The system as recited in claim 1, wherein the chemical injection tool comprises a chemical injection sub positioned in the completions string.

5. The system as recited in claim 1, wherein the chemical injection tool comprises an injection module and the fluid mixer comprises a mixer module, the mixer module being positioned to separate the measurement module from the injection module.

6. The system as recited in claim 1, wherein the measurement module is positioned proximate the downhole component.

7. The system as recited in claim 1, wherein the scale monitoring and inhibition system comprises a plurality of measurement modules and a plurality of chemical injection tools.

8. The system as recited in claim 1, wherein the measurement module and chemical injection tool operate in real-time with respect to changes in the at least one downhole parameter.

9. The system as recited in claim 1, wherein the measurement module detects water cut.

10. The system as recited in claim 1, wherein the measurement module detects pressure changes.

11. The system as recited in claim 1, wherein the measurement module detects temperature changes.

12. The system as recited in claim 1, wherein the measurement module detects flow rate changes.

13. A method of reducing scale formation in a wellbore, comprising:

measuring at least one parameter of a well in a location associated with a well component;

determining potential scale formation conditions based on measurements of the at least one parameter;

injecting a scale inhibitor chemical in response to a control system command, based on the potential scale formation conditions, into an area which causes the scale inhibitor chemical to interact with the well component; and mixing the scale inhibitor chemicals with a fluid mixer positioned downhole in the wellbore.

14. The method as recited in claim 13, wherein measuring comprises detecting water cut in a produced hydrocarbon fluid.

15. The method as recited in claim 13, wherein measuring comprises detecting temperature, pressure and flow changes.

16. The method as recited in claim 13, wherein measuring comprises monitoring the at least one parameter with a measurement module positioned downhole proximate the well component.

17. The method as recited in claim 13, wherein injecting comprises injecting a mixture of scale inhibitor chemicals.

18. The method as recited in claim 13, wherein injecting comprises automatically injecting in real-time based on changes in the at least one parameter.

19. The method as recited in claim 13, further comprising routing both an electrical line and a chemical injection line to a chemical injection module to provide both scale inhibitor chemical and power to the chemical injection module.

20. A system, comprising:

a downhole scale monitoring and inhibition system comprising a plurality of measurement modules which monitor at least one downhole parameter indicative of the potential for scale formation in at least one wellbore section; and a plurality of injection modules, wherein the injection modules are operated in real-time, based on data output by the measurement modules, to provide a downhole, local injection of controlled, relative proportions of a chemical at different locations along the at least one wellbore section to reduce scale formation.

21. The system as recited in claim 20, further comprising a flow control valve positioned in cooperation with each injection module such that the injection module injects the chemical for mixing with the produced fluids flowing by the flow control valve.

22. The system as recited in claim 20, further comprising a control system able to make an injection decision downhole to control at least one injection module.

* * * * *